US005319281A

United States Patent [19]

Roth

[11] Patent Number: 5,319,281

[45] Date of Patent: Jun. 7, 1994

[54] FLUORESCENT TUBE HEATING AND STARTING CIRCUIT

[75] Inventor: Harald Roth, VS-Villingen, Fed. Rep. of Germany

[73] Assignee: Deutsche Thomson-Brandt GmbH, Villingen-Schwennigen, Fed. Rep. of Germany

[21] Appl. No.: 872,754

[22] Filed: Apr. 24, 1992

[30] Foreign Application Priority Data

Oct. 24, 1989 [DE] Fed. Rep. of Germany ..... 3935331

[51] Int. Cl.[5] ..... H05B 39/00; H05B 41/29

[52] U.S. Cl. ..... 315/94; 315/98; 315/105; 315/DIG. 5; 315/DIG. 7

[58] Field of Search ..... 315/94, 95, 98, 105, 315/DIG. 5, DIG. 7

[56] References Cited

U.S. PATENT DOCUMENTS 4,503,362 3/1985 Hanlet ..... 315/105

FOREIGN PATENT DOCUMENTS 3608362 3/1986 Fed. Rep. of Germany .

2212995 8/1989 United Kingdom .

*Primary Examiner*—Robert J. Pascal

*Assistant Examiner*—Michael B. Shingleton

*Attorney, Agent, or Firm*—J. S. Tripoli; E. P. Herrmann; L. L. Hallacher

[57] ABSTRACT

A circuit, having a split primary transformer, for controlling the warm-up, ignition and normal operating stages of a fluorescent tube initially applies in phase voltages to opposite sides of the split primary transformer during a warm-up stage; during an ignition stage and during the normal tube operation, out of phase voltage waveforms are applied to opposite sides of the split primary of the transformer.

6 Claims, 1 Drawing Sheet

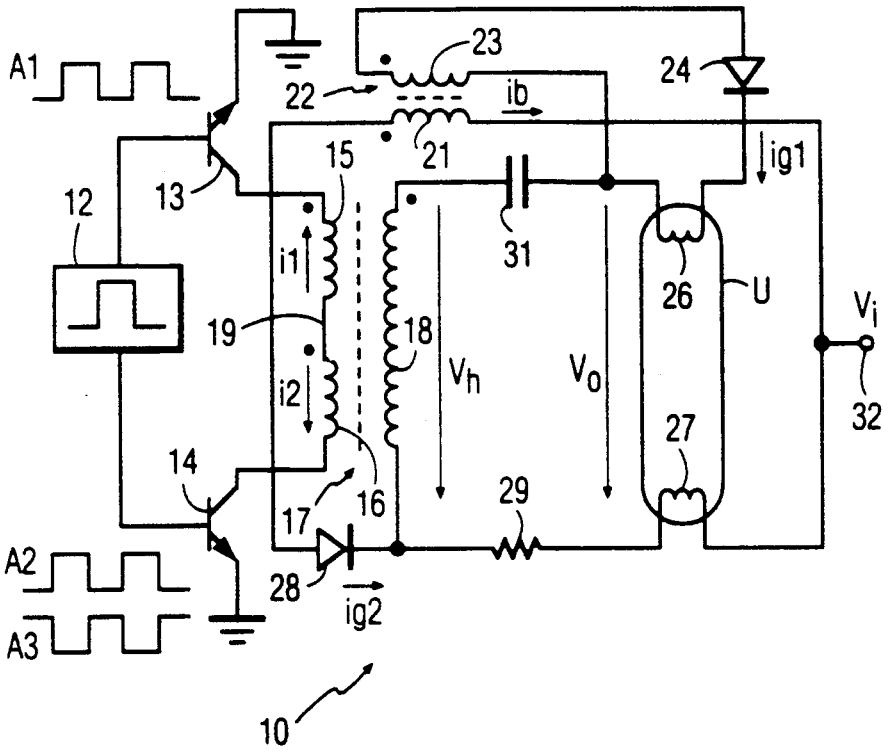
A1
A2
A3
12
13
14
15
16
17
18
19
21
22
23
24
26
27
28
29
31
32
10
U
i1
i2
ib
ig1
ig2
Vh
Vo
Vi

FLUORESCENT TUBE HEATING AND STARTING CIRCUIT

BACKGROUND

This is a continuation of PCT application PCT/EP 90/01748 filed Oct. 16, 1990 by Harald Roth and titled "Flourescent Tube Heating And Starting Circuit".

This invention is directed to a circuit for heating and starting a fluorescent tube which can be used for back illuminating a liquid crystal display device.

A prior art circuit for turning on a fluorescent lamp used, for example, to back-light a liquid crystal display has three stages of operation: warm-up, ignition and normal operating. During the warm-up stage the electrodes of the tube are pre-warmed by a current provided by a heating winding. The high voltage needed to fully operate the tube is not switched on during the warm-up stage. In the ignition stage, a voltage which is sufficiently high to cause the ignition of the tube, is switched on. At this time the heating current decreases to a low value close to zero. In the normal operating stage, the high voltage decreases to a value lower than the ignition voltage and the heating current further decreases and can go to zero. In the prior art circuit, a high voltage switch is used on the secondary side of a high voltage transformer to switch the high voltage on at the start of the ignition phase. A high voltage switch of this type is relatively expensive and prone to interference because of the necessary high blocking voltage resistance. A circuit of the type described above is described in GB-A2 212 995. This circuit includes a first transformer having a series connection of two primary windings. The midpoint of the series connection is connected to an operating voltage and the ends of the windings are connected to two power transistors. A secondary winding supplies high voltage for the tube. A control circuit controls the power transistors by two alternating voltages.

The invention is advantageous over the prior art circuits in by the provision of a fluorescent tube starting circuit which operates with the three stages of warm-up, ignition and operation and which eliminates the need for a high voltage switch.

SUMMARY

In the inventive circuit a transformer is operated in an in-phase (synchronous) mode during a filament warm-up stage. At the beginning of an ignition stage the transformer is switched to an out-of-phase (push-pull) mode and produces a sufficiently high voltage to turn the fluorescent tube on. The change over in operational mode requires very little power because the change over occurs within a control circuit which is used to drive a pair of power transistors. The change over from the in-phase mode to the push-pull mode triggers the switching-on of the high ignition voltage needed to turn the tube on and also simultaneously substantially reduces the heating current supplied to the fluorescent tube.

BRIEF DESCRIPTION OF THE DRAWINGS

The FIGURE is a preferred embodiment of the invention.

DETAILED DESCRIPTION

In the FIGURE, a circuit 10 for turning on a fluorescent tube 11 includes a control circuit 12, which drives two power transistors 13 and 14. The transistors 13 and 14 are respectively coupled to the primaries 15 and 16 of a split primary transformer 17. The input voltage $V_i$ is applied across an input terminal 32 and node 19. The secondary winding 18 of the transformer 17 provides the high ignition voltage $V_h$ needed to start the tube 11. The mid-point node 19 of the primary windings 15 and 16 is connected to the primary winding 21 of a second transformer 22, the secondary winding 23 of which is connected, via a diode 24, to one heating filament 26 of the tube 11. The mid-point node 19 is also connected to a second heating filament 27 by a diode 28 and a resistor 29. The high voltage $V_h$ provided by the secondary winding 18 is coupled via a capacitor 31 to the heating filaments 26 and 27, which are the electrodes of the tube 11. The capacitor 31 operates as a capacitance load, and the voltage across the capacitor 31 is the difference voltage between the high ignition voltage $V_h$ and the lower operating voltage $V_o$. The operation of circuit 10 for the three named stages is described below.

In the warm-up stage, the triggering circuit 12 generates two in-phase triggering voltages A1 and A2, having a frequency of 34 kHz for example. The voltages A1 and A2 are applied to transistors 13 and 14 so that the transistors are alternately on and off. Therefore, two currents $i_1$ and $i_2$, which are equal but opposite in direction flow in the windings 15 and 16, respectively. These currents produce oppositely poled magnetic fields and thus neutralize one another and no voltage is induced in the secondary winding 18. The voltages $V_h$ and $V_o$ are therefore zero, as is desired, and there is no voltage across the tube 11. However, a pulsating direct current $i_b$ flows through the primary winding 21 of transformer 22. The secondary winding 23 of transformer 22 generates a pulsating voltage which supplies a heating current $ig_l$, of about 90 mA for example, for the filament 26 of the tube 11 via diode 24. At the mid-point node 19, the pulsating voltage also generates a pulsating heating current $ig_2$, also about 90 mA for example, which is supplied to heating filament 27 via diode 28 and resistor 29. The warm-up of the filaments 26 and 27 takes about 2 seconds, for example. The size of the transformer 22 can be reduced by increasing the frequency of the triggering voltages A1 and A2.

For the ignition stage the triggering voltage A2 is phase shifted 180° by the control circuit 12 into a voltage A2' which is 180° out of phase with the initial voltage A1, and current $i_2$ changes direction. Such phase shifting within control circuit 12 is within the skill of the art. The transistors 13 and 14 are then operated in a push-pull mode. A high voltage $V_h$, of approximately 500 V for example, is generated across the winding 18 because the currents $i_1$ and $i_2$ are equal but alternating in time, as they flow through the windings 15 and 16 respectively. The voltage $V_o$ is applied across the tube 11 and initially, has a value greater than the ignition voltage of tube 11. The tube 11 is therefore turned on. The current ib which flows through the primary winding 21 of transformer 22 is alternately the current $i_1$ which is provided by transistor 13 and in the next half-wave, the current $i_2$ which is provided by transistor 14. The voltage induced in the secondary winding 23 drops to a very low level because the current $i_b$ through the primary winding 21 is constant except for minor harmonic waves. The transformer 22 thus acts as a smoothing choke, while the transformer 17 works as a push-pull converter. The heating current $ig_1$ thus drops to a low value, as is desired during the normal operation. The calorific output drops to approximately one-twentieth of the original value, and ideally drops to zero. The voltage at the mid-point node 19 remains at the value of the input voltage $V_i$, decreased by the voltage across the primary winding 21. Accordingly, the diode 28 is blocked and the heating current $ig_2$ is also switched off in the desired manner.

The reduction in current $ig_2$ reduces the charge on capacitor 31. Accordingly, in the normal operating phase the effective high voltage $V_o$ across the tube 11 decreases to a value well below the ignition voltage, for example 170 volts. During the normal operating stage the out-of-phase operation of control circuit 12 continues and an efficient operation of the tube 11 is realized.

What is claimed is:

1. A circuit for controlling the heating, ignition and normal operation of a fluorescent tube comprising:

a first transformer having a primary winding split at a node, said first transformer applying currents to said fluorescent tube;

a control circuit for applying two alternating voltage waveforms having substantially equal amplitudes and frequencies to said primary, said waveforms being in phase with each other during a warm-up stage and out of phase during an ignition stage and during normal operation of said tube.

2. The circuit of claim 1 wherein said fluorescent tube includes at least two filaments, and wherein said control circuit provides warm-up currents to said filaments through opposite sides of said split primary; and wherein said circuit further includes voltage responsive current control means in series with said filaments.

3. The circuit of claim 2 further including a second transformer arranged between said node and one of said filaments.

4. The circuit of claim 3 wherein said node is a midpoint node and wherein the input voltage for said circuit is applied to said midpoint node.

5. The circuit of claim 4 further including transistors individually arranged between said control circuit and the sides of said split primary.

6. A method of operating a warm-up and operating circuit for a fluorescent tube having at least two filaments, said circuit having a split primary transformer with a midpoint node, and a control circuit for providing individual waveforms to the sides of said split primary, said method including the steps of:

providing two in-phase waveforms to opposite sides of said split primary during a warm-up stage, said in phase waveforms having substantially equal amplitudes and frequencies; and providing two out-of-phase waveforms to opposite sides of said split primary during an ignition stage and during the normal operating stage of said tube, said out-of-phase waveforms having substantially equal amplitudes and frequencies.

* * * * *